US006300729B1

(12) United States Patent
Keijser et al.

(10) Patent No.: US 6,300,729 B1
(45) **Date of Patent: *Oct. 9, 2001**

(54) METAL HALIDE LAMP WITH INCREASED LAMP VOLTAGE

(75) Inventors: Robertus Antonius J. Keijser; Johannes G. W. Etman, both of Eindhoven (NL); Hannelore M. L. E. Herremans, Turnhout (BE)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/490,484

(22) Filed: Jan. 24, 2000

(30) Foreign Application Priority Data

Jan. 28, 1999 (EP) ..... 99200253

(51) Int. Cl.[7] ..... H01J 17/00; H01J 17/02

(52) U.S. Cl. ..... 315/326; 315/56; 313/620; 313/638

(58) Field of Search ..... 315/240, 326, 315/246, 56–60; 313/606, 620, 637–641, 570, 571, 643, 644

(56) References Cited

U.S. PATENT DOCUMENTS

| | | | | |
|---|---|---|---|---|
| 3,639,801 | | 2/1972 | Jacobs et al. | 313/223 |
| 4,161,672 | | 7/1979 | Cap et al. | 313/220 |
| 4,439,711 | * | 3/1984 | Murakami et al. | 313/639 |
| 5,097,176 | * | 3/1992 | De Hair et al. | 313/620 |
| 5,153,482 | * | 10/1992 | Keijser et al. | 313/634 |
| 5,525,863 | | 6/1996 | Kowalczyk et al. | 313/634 |
| 5,923,127 | | 7/1999 | Keijser | 315/240 |
| 5,973,453 | * | 10/1999 | Van Vilet et al. | 313/620 |
| 6,031,332 | * | 2/2000 | Wijenberg et al. | 313/639 |
| 6,069,456 | * | 5/2000 | Fromm et al. | 315/246 |
| 6,137,230 | * | 10/2000 | Born et al. | 313/634 |
| 6,147,453 | * | 11/2000 | Geijtenbeek et al. | 313/640 |

FOREIGN PATENT DOCUMENTS

| | | | |
|---|---|---|---|
| WO9825294 | 6/1998 | (WO) | H01J/61/02 |
| WO9928946 | 6/1999 | (WO) | H01J/61/12 |

* cited by examiner

*Primary Examiner*—Don Wong
*Assistant Examiner*—Wilson Lee
(74) *Attorney, Agent, or Firm*—Dicran Halajian

(57) ABSTRACT

A metal halide lamp intended to be operated on an electronic ballast includes a discharge vessel having a ceramic wall enclosing a discharge space which contains an ionizable filling comprising, in addition to Hg, a quantity of Na halide. Two electrodes have tips arranged at a mutual distance EA, the discharge vessel having an internal diameter Di at least through the distance EA, wherein EA/Di≧2.5, while the lamp has a nominal lamp voltage Vla of ≧110 V.

12 Claims, 2 Drawing Sheets

METAL HALIDE LAMP WITH INCREASED LAMP VOLTAGE

BACKGROUND OF THE INVENTION

The invention relates to a metal halide lamp intended to be operated on an electronic ballast, which lamp comprises a discharge vessel having a ceramic wall enclosing a discharge space which contains an ionizable filling comprising, in addition to Hg, a quantity of Na halide, two electrodes with tips being arranged at a mutual distance EA, and the discharge vessel having an internal diameter Di at least through the distance EA.

A lamp of this type is described in U.S. Pat. No. 5,923,127. The known lamp, which has eminent color properties (inter alia, general color rendering index Ra≧80 and a color temperature $T_c$ of 3000 K), is integrated with the electronic ballast in the form of a switched-mode power supply (smps) and is thus very suitable as a light source for, inter alia, interior lighting. This lamp is based on the recognition that a good color rendition is possible when Na halide is used as a filling constituent of a lamp and a strong widening and reversal of the Na emission in the Na-D lines occurs during lamp operation. This requires a high temperature of, for example, 1170 K (900° C.) of the coldest spot $T_{kp}$ in the discharge vessel. When reversing and widening the Na-D lines, these take the shape of an emission band in the spectrum with two maxima at a mutual distance $\Delta\lambda$.

The requirement for a high value of $T_{kp}$ results in a relatively small discharge vessel, which, in the practical lamp, leads to a wall load of 70 W/cm$^2$ measured across the internal surface area of the cylindrical part of the discharge vessel through the distance EA. The required high temperature precludes the use of quartz or quartz glass for the wall of the discharge vessel and necessitates the use of ceramic material for the wall of the discharge vessel.

The ceramic wall in this description and claims is understood to mean both a wall of metal oxide such as, for example, sapphire or densely sintered polycrystalline $Al_2O_3$, or metal nitride, for example AlN.

The electronic ballast comprises a high-frequency converter which converts, as smps, the low-frequency power supply of the mains into a high-frequency current through the lamp. In this case, it should be ensured that the high frequency is chosen to be such that it does not give rise to acoustic resonance phenomena in the lamp. Another, generally used configuration as an smps for high-pressure discharge lamps consists of a concatenation of rectifier means, a preconditioner, a converter and a commutator to which the lamp is connected. The preconditioner is used for generating a DC voltage for power supply of the converter while withdrawing a current which is sinusoidal in a satisfactory approximation from the mains operating as the power supply source. The commutator provides for an, often low-frequency, AC current through the lamp. Both forms of the electronic ballast are designed in such a way that the voltage across the lamp is approximately 90 V in the nominal operating condition of the connected lamp. It is thereby achieved that the relevant electronic ballast is suitable for operating known lamps which are generally designed for operation at a lamp voltage of approximately 90 V and can be operated on a ballast in the form of a ballast coil.

In addition to Na, the filling of the discharge vessel may comprise Tl and/or one of the rare earth metals, with which a desired value for the general color rendering index Ra≧80 and the color temperature $T_c$ between 2700 K and more than 4200 K is realized. In this description and claims, the elements Y and the lanthanides are considered as rare earth metals. Due to the formation of compounds with $O_2$ in ceramic discharge vessels based on metal oxide, Sc is not suitable as a filling constituent.

A drawback of the known lamp is that it has a relatively low specific light output. A further drawback of the known lamp is that, also as a result of the relatively small dimensions of the discharge vessel, a relatively rapid blackening of the wall of the discharge vessel occurs, inter alia, due to deposition of evaporated material on the wall of the electrodes, so that the lumen maintenance and hence the practical lifetime of the lamp is influenced very detrimentally.

SUMMARY OF THE INVENTION

It is an object of the invention to provide a measure to combat the described drawbacks while maintaining the satisfactory color properties of the lamp. According to the invention, a lamp as described in the opening paragraph is therefore characterized in that the relation EA/Di≧2 is satisfied, and in that, during nominal operation of the lamp, a lamp voltage Vla satisfying the relation Vla≧110 V is present across the lamp.

In the lamp according to the invention, it has surprisingly been found that a specific light output above 100 lm/W in combination with a value for the general color rendition Ra≧80 can be realized. The lamp voltage Vla is preferably at most 400 V. Higher voltages do not lead to a significant improvement of the properties of the lamp but require special efforts for realizing a suitable electronic ballast.

A relatively large electrode distance EA provides the possibility of applying a relatively low wall load, which is favorable for the lifetime of the lamp. During nominal operation, the lamp according to the invention preferably has a wall load Wla which satisfies the relation 30≦Wla≦70 in W/cm$^2$.

In a preferred embodiment of the lamp according to the invention, the discharge vessel also comprises Ce halide. This has the important advantage that a further increase of the specific light output (efficacy) is obtained while maintaining the satisfactory color properties of the light generated by the lamp. In addition to Na, the filling of the discharge vessel may comprise one or more other metals which form halides, inter alia, for influencing the color properties of the lamp, such as Tl, Dy, Ho and Tm, for example, for raising the color temperature. Moreover, an addition of Ca halide is also suitable.

It holds for Hg that, as is customary for metal halide, it is completely in the vapor phase in its operational state and constitutes the most important lamp voltage-determining value. It has also been found that Hg influences the color rendition. Notably for realizing values for the general color rendition Ra≧80, a sufficiently high pressure of the Hg appears to be necessary. To prevent a too high lamp voltage Vla, on the one hand, and an insufficiently high pressure of the Hg, on the other hand, the ratio EA/Di is preferably ≦5.5.

These and other aspects of the invention are apparent from and will be elucidated with reference to the embodiment(s) described hereinafter.

DETAILED DESCRIPTION OF THE PREFERRED EMBODIMENTS

Figure 1:
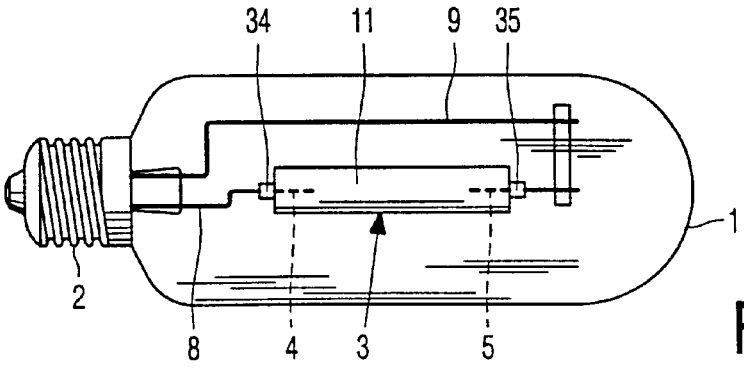
FIG. 1 shows a lamp according to the invention.
Figure 2:
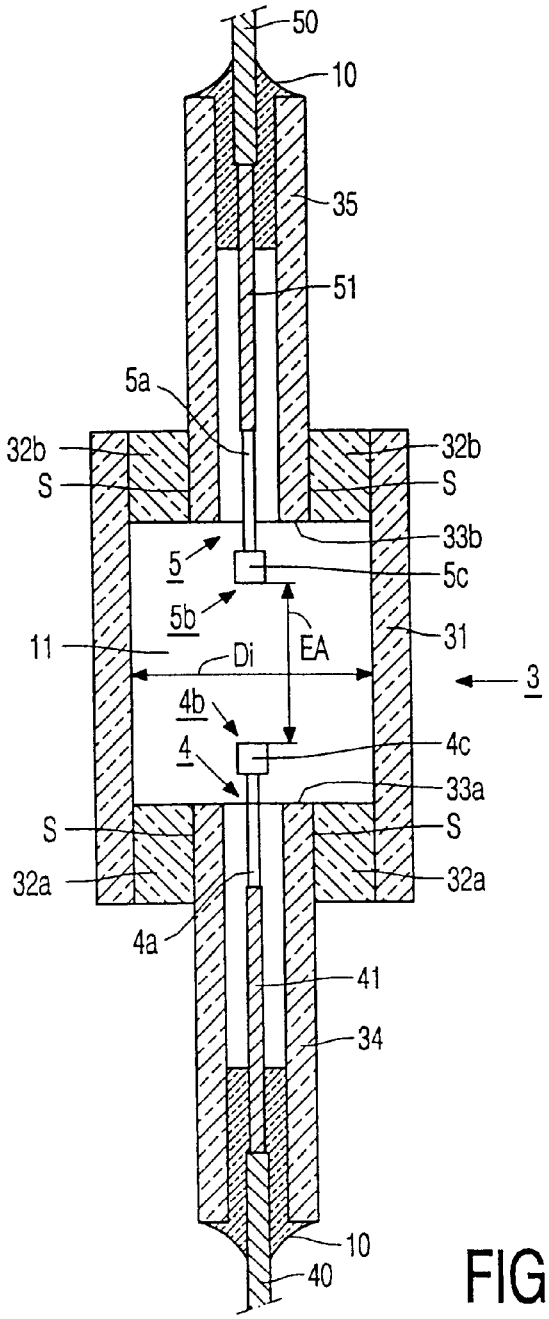
FIG. 2 is a cross-section of a discharge vessel of the lamp shown in FIG. 1.
Figure 3:
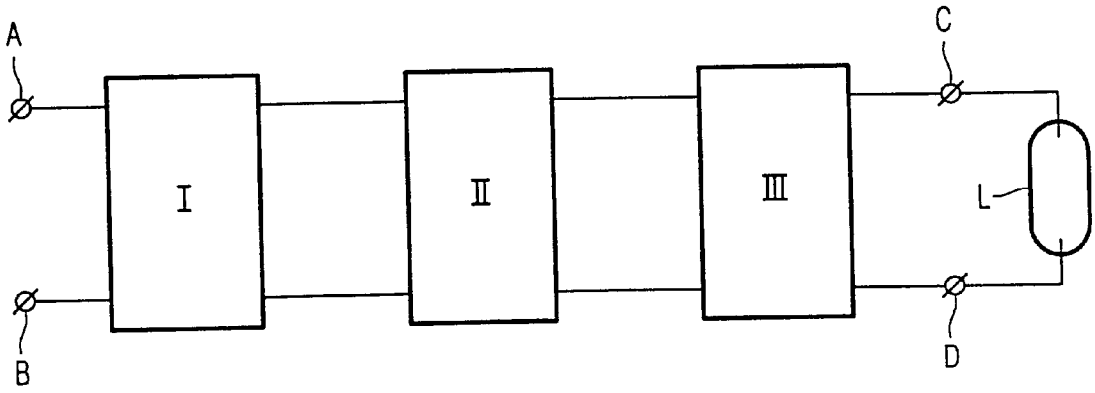
FIG. 3 shows the lamp of FIG. 1, connected to an electronic ballast.

FIG. 1 shows a metal halide lamp comprising a discharge vessel 3 shown in a cross-section and not to scale in FIG. 2 and having a ceramic wall enclosing a discharge space 11 which contains an ionizable filling in the lamp shown of not only Hg and a quantity of Na halides but also Tl and Dy and Ce halides. Two electrodes 4, 5 with electrode bars 4*a*, 5*a* and tips 4*b*, 5*b* are arranged in the discharge space at a mutual distance EA, in the drawing each of W. The discharge vessel has an internal diameter Di at least through the distance EA. The discharge vessel is sealed at one side by a ceramic projecting plug 34, 35 which tightly encloses a current feedthrough conductor 40, 41 and 50, 51 with an interspace to the electrodes 4, 5 arranged in the discharge vessel and is connected thereto in a gastight manner by means of a melt-ceramic compound 10 near one end remote from the discharge space. The discharge vessel is enclosed by an outer envelope 1 provided at one end with a lamp cap 2. In the operational state of the lamp, a discharge extends between the electrodes 4, 5. Electrode 4 is connected via a current conductor 8 to a first electric contact which forms part of the lamp cap 2. Electrode 5 is connected via a current conductor 9 to a second electric contact which forms part of the lamp cap 2. The metal halide lamp shown is intended to be operated on an electronic ballast as is shown in FIG. 3. The lamp indicated by L in FIG. 3 is connected by means of electric contacts of lamp cap 2 to connection points C, D of a commutator III, for example, a bridge circuit. A, B denote input terminals of the ballast and are intended for connection to a power supply source, for example, a mains of 220 V, 50 Hz. In the ballast, I denotes rectifier means and a preconditioner for generating a DC voltage for power supply of a converter II. Very suitable as a preconditioner is, for example, an up-converter or boost converter for withdrawing a current, which is sinusoidal in a good approximation, from the mains operating as the power supply source. A suitable example of a converter is a down-converter or a Buck converter. Another type of circuit which is usable as a converter II is a flyback converter. During nominal operation of the lamp shown, a lamp voltage Vla satisfying the relation Vla ≧110 V is present across the lamp. The lamp voltage is measurable between the electric contacts which form part of the lamp cap 2 and, in a good approximation, corresponds to the voltage between the electrode tips 4*b*, 5*b*.

In a first, practical embodiment of lamps according to the invention and as shown in the drawings, the nominal power of the lamp is 39 W. The translucent wall of the discharge vessel has a thickness of 0.8 mm. The ionizable filling of the lamp comprises, in addition to Hg, 5.5 mg of Na+Tl+Dy+Ce iodide with a composition of 85.3; 3.6; 4.8 and 6.3 in mol %. Moreover, the discharge vessel comprises Ar as a starter with a filling pressure of 400 mbar. Table I states further data and results. For lamp Prototype 1 the Hg filling amount is 2.1 mg and for lamp Prototype 2 it is 2.5 mg.

TABLE I

| Prototype | Hg $\mu g/mm^3$ | Di (mm) | EA (mm) | EA/Di | $V_{la}$ (V) | $\Delta\lambda$ (nm) | Efficacy (lm/W) | Ra | $T_c$ (K) | $T_{kp}$ (K) | $W_{bel}$ ($W/cm^2$) |
|---|---|---|---|---|---|---|---|---|---|---|---|
| 1 | 30 | 3 | 8 | 2.67 | 150 | 7.5 | 107 | 88 | 2940 | 1300 | 51 |
| 2 | 25.5 | 3 | 12 | 4 | 200 | 5.3 | 115 | 82 | 2930 | 1280 | 35 |

In a second practical embodiment of lamps according to the invention, the nominal power of lamps is 75 W. Table II states the data and results of these lamps.

TABLE II

| Prototype | Hg $\mu g/mm^3$ | Di (mm) | EA (mm) | EA/Di | $V_{la}$ (V) | $\Delta\lambda$ (nm) | Efficacy (lm/W) | Ra | $T_c$ (K) | $T_{kp}$ (K) | $W_{bel}$ ($W/cm^2$) |
|---|---|---|---|---|---|---|---|---|---|---|---|
| 1 | 24.5 | 4 | 12 | 3 | 205 | 4.3 | 118 | 87 | 2940 | 1330 | 50 |
| 2 | 24 | 4 | 15 | 3.75 | 245 | 3.2 | 117 | 85 | 2960 | 1295 | 40 |
| 3 | 25 | 4 | 9 | 2.25 | 175 | 5.3 | 110 | 91 | 2950 | 1345 | 66 |

In a further practical embodiment of a lamp according to the invention, the filling of the discharge vessel comprises 5.75 mg of Na, Tl, Dy, Ce iodide in a weight ratio of 64.3; 6.0; 13.1 and 16.5. The nominal power of the lamp is 75 W. The electrode distance EA is 12 mm, the internal diameter is 4 mm which corresponds to a wall load $W_{bel}$ of 49.7 $W/cm^2$ in the operational state. During operation, a Hg pressure of 35 bar prevails in the discharge vessel and the lamp voltage Vla is 232 V. The lamp having a specific light output value of 109 lm/W emits light at a color temperature $T_c$ of 2800 K with a value of 90 for the general color rendering index Ra.

For a comparable lamp, the values of EA and Di are 9 mm and 4.5 mm, respectively, the Hg pressure during operation is 43 bar and the lamp voltage Vla is 202 V. The specific light output values, $T_c$ and Ra of this lamp are 106 lm/W, 3050 K and 93, respectively. In this case, the wall load Wla is 59 $W/cm^2$. For a lamp with a discharge vessel of the same construction, the Hg pressure during operation is 31 bar. The lamp operated in a vertical position has a lamp voltage of 147 V, a specific light output of 115 Im/W, a color temperature $T_c$ of 3670 K of the emitted light and an Ra value of 82.

In a further practical embodiment of the lamp according to the invention, the nominal power of the lamp is 39 W. The electrode distance EA is 8 mm, the internal diameter Di is 3 mm. In addition to Hg with a pressure of 31 bar in the operational state, the filling of the discharge vessel comprises 5.7 mg of Na, Ca, Ce, Dy-iodides in a mol % of 47; 39.2; 7.7; 6.1. For a 100-hour lifetime of the lamp, lamp properties were measured with the following results: lamp voltage Vla 174 V; specific light output 106 Im/W; color temperature $T_c$ 3965 K; general color rendering index Ra 89. After a lifetime of 1000 hours, these measured values were 178 V; 101 lm/W; 3801 K; 87, respectively.

A further practical lamp of a corresponding construction and nominal power is provided with 1 mg of Hg and 5.6 mg of Na, Ca, Ce, Dy iodide in a mol % of 45.2; 37.7; 11.2; 5.9. The lamp voltage for lifetimes of 100 hours and 1000 hours was 150 V and 153 V, respectively. The value of the specific light output was 106 Im/W and 102 Im/W, respectively. The associated values for the color temperature $T_c$ and the general color rendering index Ra were 4648 K and 84, and 4569 K and 84, respectively.

What is claimed is:

1. A metal halide lamp intended to be operated on an electronic ballast, wherein said lamp comprises a discharge vessel having a ceramic wall enclosing a discharge space which contains an ionizable filling comprising, in addition to Hg, a quantity of Na halide, two electrodes with tips being arranged at a mutual distance EA, and the discharge vessel having an internal diameter Di at least through the distance EA, wherein a relation $4<EA/Di\leqq 5$ is satisfied and wherein, during nominal operation of the lamp, a lamp voltage Vla satisfying a relation $Vla\geqq 110$ V is present across the lamp.

2. A lamp as claimed in claim 1, wherein the lamp voltage Vla is at most 400 V.

3. A metal halide as claimed in claim 1, wherein during nominal operation, the lamp has a wall load Wla which satisfies a relation $30\leqq Wla<70$ in $W/cm^2$.

4. A lamp as claimed in claim 1, wherein the ratio EA/Di is $\leqq 5.5$.

5. A lamp as claimed in claim 1 also comprises Ce halide.

6. A metal halide lamp comprising:

a discharge vessel having a wall enclosing a discharge space which contains an ionizable filling comprising a quantity of Na halide, said discharge vessel having an internal diameter Di;

two electrodes with tips, said tips being located in said discharge vessel and being arranged at a mutual distance EA so that a relation $4<EA/Di\leqq 5$ is satisfied.

7. The metal halide lamp of claim 6, wherein, during nominal operation of the lamp, a lamp voltage Vla satisfying a relation $Vla>110$ V is present across the lamp.

8. The metal halide lamp of claim 7, wherein said lamp voltage Vla is at most 400 V.

9. The metal halide lamp of claim 7, wherein during nominal operation, the lamp has a wall load Wla which satisfies a relation $30\leqq Wla<70$ in $W/cm^2$.

10. A metal halide lamp comprising:

a discharge vessel having a wall enclosing a discharge space which contains an ionizable filling comprising a quantity of Na halide, said discharge vessel having an internal diameter Di;

two electrodes with tips, said tip being located in said discharge vessel and being arranged at a mutual distance EA so that a ratio EA/Di is greater or equal to two, and wherein during nominal operation of the lamp, a lamp voltage Vla satisfying a relation $Vla\geqq 120$ V is present across the lamp.

11. The metal halide lamp of claim 10, wherein said lamp voltage Vla is at most 400 V.

12. The metal halide lamp of claim 10, wherein during nominal operation, the lamp has a wall load Wla which satisfies a relation $30\leqq Wla<70$ in $W/cm^2$.

* * * * *